US005360456A

United States Patent [19]

Lecomte et al.

[11] Patent Number: 5,360,456

[45] Date of Patent: Nov. 1, 1994

[54] PROCESS OF TRANSFER PRINTING COMPRISING PRETREATMENT WITH A POLYURETHANE RESIN MIXTURE

[76] Inventors: Roger Lecomte, 24 résidence des mottes, Froyennes (Tournai); Jacques Lecomte, 131, rue de Tournai, Pecq, both of Belgium, Philippe Honore, 99, rue d'Halluin—59960 Neuville En Ferrian, France

[21] Appl. No.: 904,995

[22] Filed: Jun. 26, 1992

[30] Foreign Application Priority Data

Jul. 8, 1991 [FR] France ..... 91 08991

[51] Int. Cl.[5] ..... D06P 5/00

[52] U.S. Cl. ..... 8/471; 8/495; 8/930

[58] Field of Search ..... 8/471, 495, 930

[56] References Cited

U.S. PATENT DOCUMENTS

| | | | |
|---|---|---|---|
| 4,257,692 | 3/1981 | Le Naour-Sene | 8/471 |
| 4,795,477 | 1/1989 | Kusumsar et al. | 8/471 |
| 4,842,613 | 6/1989 | Purser | 8/471 |

FOREIGN PATENT DOCUMENTS 53-126373 11/1978 Japan .

OTHER PUBLICATIONS

Hole et al., "Transfer Printing On Urethane-Coated Fabrics", Mar. 3, 1976, Chemical Abstracts vol. 84, No. 18, Abstract No. 1232372.

Iwasaki, "Transfer Printing Of Wool, Cotton and Wool-Blend Fabrics", Apr. 30, 1979, Chemical Abstracts vol. 90, No. 18, Abstract No. 139003E.

*Primary Examiner*—Paul Lieberman
*Assistant Examiner*—Caroline L. Dusheck
*Attorney, Agent, or Firm*—Ladas & Parry

[57] ABSTRACT

This invention relates to a process for printing a textile article by heat transfer of sublimable dyes printed with the aid of a transfer paper comprising a pre-treatment of said article with a polyurethane resin, wherein the pre-treatment, prior to the transfer operation proper, consists in coating at least that face of the article intended to be in contact with the transfer paper, with a mixture of polyurethane ester resins, at least one being aromatic, at least another being aliphatic.

7 Claims, No Drawings

PROCESS OF TRANSFER PRINTING COMPRISING PRETREATMENT WITH A POLYURETHANE RESIN MIXTURE

FIELD OF THE INVENTION

The present invention relates to the technique currently referred to as transfer printing, thermo-printing or dry printing, in which dyes printed on a paper support are transferred by sublimation on a textile article. It concerns more particularly an improved process whereby this technique becomes applicable to textile articles of any composition, and particularly to pure or blended cellulosic articles.

BACKGROUND OF THE INVENTION

Transfer printing, which originated in the sixties, has been employed industrially only in a limited number of materials: polyester, acrylic, triacetate, polyamide, i.e. in articles made of synthetic fibers. This limitation is due to the very principle on which transfer printing is based, namely the migration in the fiber of dyes which were sublimated during a thermal treatment of the order of 200° C. Fibers which ere not capable of being dyed with dispersed dyes or those which do not withstand the corresponding temperature, are therefore excluded. Consequently, natural fibers and in particular cellulosic fibers are not concerned by this technique, which is preferably applied to polyester.

However, transfer printing presents undeniable advantages: no consumption of water, no pollution, low investment and little space required for the printing proper, very considerable versatility of use since, on the one hand, the same transfer paper allows printing of articles of different textures and, on the other hand, the transfer paper can be stored and printing effected as required.

Document JP 77/38077 discloses a process of transfer printing of wool, cotton or wool-polyester blend fabrics, which consists in effecting a pre-treatment of the fabric to be printed by transfer, such pre-treatment consisting in an impregnation of the fabric with an aqueous dispersion of polyurethane. The transfer paper, comprising an ink containing a sublimable dye, is applied by pressure against the treated fabric at 200° then steamed for 20 minutes at 100° C. The printed fabric obtained has shrink-resistant properties and may be used for golf wear.

Such a known process, despite all the interest that it presents, has, to Applicants' knowledge, not had real industrial applications. From the findings that they have made, Applicants consider that the pretreatment of polyurethane which is proposed in this document is not entirely satisfactory, insofar as the printed articles thus produced do not present the fastness usually required, for all types of colours. In fact, it will be readily appreciated that printed fabrics usually comprise on the same article a large number of colours and that it is important that all the dyes used for printing have an acceptable behaviour, such that there is no running when the article is used and in particular when it is washed.

It is an object of the present invention to propose a process which overcomes the major drawback of transfer printing, namely its limitation to a few synthetic fibers, and also the drawback set forth above of the process employing a prior treatment by impregnation of polyurethane, namely the running of the colours.

SUMMARY OF THE INVENTION

This object is perfectly attained by the process of the invention which is a process for printing a textile article by heat transfer of sublimable dyes printed with the aid of a transfer paper, of the type comprising a pre-treatment of said article with the aid of a polyurethane resin, characterized in that the pre-treatment, prior to the transfer operation proper, consists in coating at least that face of the article intended to be in contact with the transfer paper, with a mixture of polyurethane ester resins, at least one being aromatic, at least another being aliphatic.

Applicants have unexpectedly observed that transfer printing of excellent quality could be obtained by employing, in the pre-treatment with polyurethane, on the one hand, resins of a certain type, namely polyurethane esters, and, on the other hand, a mixture of at least two of these resins, namely a resin of aromatic type and a resin of aliphatic type. This particular selection enables the technical result expected, namely good colour fastness for the printed article, to be obtained.

The mixture of resins, during pre-treatment, is preferably applied in the form of an aqueous dispersion.

Excellent results have been obtained from a mixture of two polyurethane ester resins, in substantially equal proportions, the first being an aromatic polyurethane ester and the second an aliphatic polyurethane ester.

A further improvement may be obtained, concerning colour fastness when washing at 50° , by adding to the mixture of resins a derivative of formaldehyde, for example melamine formaldehyde.

Of course, melamine formaldehyde is already known in the field of dyeing to improve the fastness of certain dyes to washing. However, up to the present time, the melamine formaldehyde was used for improving the fastness to washing of soluble dyes, in a finishing treatment of the article already dyed. In the present case, on the one hand, the dyes used in transfer printing are dispersed dyes and not soluble dyes, and, on the other hand, the melamine formaldehyde is applied during a pre-treatment of the article, before printing, and not during a post-treatment of the article already dyed. Thus, according to Applicants, the use of a derivative of formaldehyde in the mixture of polyurethane ester resins in the course of the pre-treatment of the article to be printed by transfer, did not, within the normal scope of the man skilled in the art, improve the fastness to washing of the printed article.

Furthermore, it has been found that it was possible to improve the touch of the printed article by adding in the mixture of polyurethane ester resins a siliconed compound, for example hexamethyl polysiloxane. Of course, the man skilled in the art knows that this type of compound may be used for improving the touch of the articles, but this is usually done on the finished article and not, as in the present case, during a pre-treatment, prior to the application itself of the dye. Thus, it has been unexpectedly found that the use in the mixture of polyurethane ester resins of a siliconed compound does not disturb the transfer printing proper, i.e. does not prevent the sublimable dyes from migrating inside the mixture of resins and being fixed therein. What's more, it has been observed that the presence of siliconed compounds further improved wash-resistance.

The resin is preferably applied on the two faces of the article by full-bath impregnation in a padding mangle.

According to the preferred mode of carrying out the process, this full-bath impregnation is effected with an aqueous dispersion containing from 2 to 4% of an aliphatic polyurethane ester resin, from 2 to 4% of an aromatic polyurethane ester resin, from 1 to 2% of melamine formaldehyde and from 1 to 2% of hexamethyl polysiloxane.

The application of the resin is followed by a drying step intended to eliminate the water and to obtain partial or total polymerization of the resin.

The textile article, dried and thus coated with the mixture of polyurethane ester resins, is then subjected to the transfer operation. This operation may be carried out continuously after the steps of application of the resin and of drying, or, preferably, discontinuously, the dried, resin-coated article being transitorily stored.

The transfer operation proper is carried out under the usual conditions, by means for example of a calender.

The invention will be more readily understood on reading the following description of several examples of embodiment of the invention.

EXAMPLE 1

Transfer printing is effected on a jersey knit of polyester of 150 g/m$^2$, on a calender under the following conditions: temperature of 215° C., dwell time: 25 seconds.

The treatment was carried out, on the one hand, with an ink/water transfer paper and, on the other hand, with an ink/solvent transfer paper.

In both cases, the polyester knit thus printed has a very good colour yield. Furthermore, the fastness to light and to washing is as follows: 4 to 7 depending on the dyes for fastness to light and from 3 to 5 for fastness to washing, in accordance with ISO standards.

EXAMPLE 2

Transfer printing is effected under the same conditions as for Example 1, on a pure cotton jersey knit having the same W.S.M. and the same texture.

The cotton fabric thus printed has a lackluster appearance and the fastness is very poor with respect both to light and to washing.

EXAMPLE 3

On the same cotton knit as in Example 2, a mixture of two polyurethane ester resins is applied according to the invention, one being of the aliphatic type and the other of the aromatic type. This application is made from an aqueous dispersion comprising from 2% to 4% of the aliphatic polyurethane ester resin, from 2 to 4% of the aromatic polyurethane ester resin, from 1 to 2% of melamine formaldehyde and from 1 to 2% of hexamethyl polysiloxane. If the resins are in the form of dispersions ready for use, the percentage of active matters should be taken into account to obtain the above-mentioned percentages, which are percentages by weight.

The cotton knit passes continuously in an impregnation padding mangle, containing the dispersion of the mixture of resins. Adjustment of the pressure of the rollers of the mangle is provided in order to obtain a take-away rate of the order of 100%.

The cotton knit thus impregnated then passes in a drying tunnel, then is wound. The knit comprises a dry deposit of the order of 3 to 10%, by weight, of the mixture of resins based on polymerized, aromatic and aliphatic, polyurethane esters.

Transfer printing is effected on the knit thus coated, under the same conditions and with the same transfer papers as in Examples 1 and 2 hereinabove.

The cotton knit thus printed presents the same colour yield as the polyester knit of Example 1, with very good fastness both to light and to washing, as well as an excellent touch.

Example 4

The pre-treatment of impregnation of the mixture of the two polyurethane ester resins is effected with the same dispersion as in Example 3, during manufacture of a cotton fabric on a weaving loom of the water-jet type. To that end, the dispersion is added to the water serving to propel the weft yarn through the shed. This is rendered possible since the products employed in the dispersion are not corrosive and do not alter the behaviour of the water jet propelled under pressure. In particular, the presence of the dispersion does not substantially modify the viscosity of the water used.

In this way, the weft yarn is impregnated with the dispersion containing the mixture of the aliphatic and aromatic polyurethane ester resins.

Transfer printing may, moreover, be effected on the wet fabric leaving the water-jet weaving loom.

Although only the weft yarns are subjected to impregnation, it has proved that the aqueous dispersion migrates sufficiently during manufacture and storage of the roll of fabric, so that a printed fabric is obtained which is substantially comparable to that obtained by full-bath impregnation.

The invention is not limited to the embodiment which has been described by way of non-limiting example. In particular, it is within the scope of the man skilled in the art to determine, in the range of aliphatic and aromatic polyurethane ester resins, those which are most appropriate as a function of the textile article to be printed.

Of course, the invention also covers the textile articles, of whatever nature and composition, which are obtained by the process described above, and which therefore comprise, on both faces or on one face a mixture of resins, comprising at least two polyurethane ester resins, one aliphatic and the other aromatic, on which dispersed dyes are fixed. It may be question of articles of cellulosic fibers, cotton, linen, viscose, etc . . . , pure or blended, particularly with other cellulosic fibers or with elastothane fibers or with acrylic fibers; it may be question of pure or blended wool articles, without this list being limiting.

What is claimed is:

1. A process for printing a textile article by heat transfer of sublimable dyes printed with the aid of a transfer paper, comprising a pre-treatment of said article by a mixture of polyurethane resins, wherein the pre-treatment, prior to the transfer of said sublimable dyes consists in coating at least that face of the article intended to be in contact with the transfer paper, with a mixture of polyurethane ester resins, at least one being aromatic, at least another being aliphatic wherein said mixture is comprised of substantially equal portions of said polyurethane ester resins.

2. The process of claim 1 wherein the mixture of resins, in the course of pre-treatment, is applied in the form of an aqueous dispersion.

3. The process of claim 2, wherein the aqueous dispersion comprises melamine formaldehyde.

4. The process of one of claims 2 or 3, wherein the aqueous dispersion contains hexamethyl polysiloxane.

5. The process of claim 1, wherein the resin mixture is applied on two faces of the article by full-bath impregnation in a padding mangle.

6. The process of claim 5, wherein said full-bath impregnation is effected with an aqueous dispersion containing from 2 to 4% of an aliphatic polyurethane ester resin, from 2 to 4% of an aromatic polyurethane ester resin, from 1 to 2% of melamine formaldehyde and from 1 to 2% of hexamethyl polysiloxane.

7. The process of claim 2, wherein the article is a fabric obtained on a water-jet weaving loom wherein the aqueous dispersion containing the mixture of polyurethane ester resins propels a weft yarn through a shed.

* * * * *